US010045681B2

(12) United States Patent
Schessl et al.

(10) Patent No.: US 10,045,681 B2
(45) Date of Patent: Aug. 14, 2018

(54) CUTLERY BASKET FOR A DISHWASHER AND DISHWASHER

(75) Inventors: Bernd Schessl, Dillingen (DE); Rainer Schütz, Neresheim (DE)

(73) Assignee: BSH Hausgeräte GmbH, Munich (DE)

( * ) Notice: Subject to any disclaimer, the term of this patent is extended or adjusted under 35 U.S.C. 154(b) by 1201 days.

(21) Appl. No.: 12/515,418

(22) PCT Filed: Nov. 5, 2007

(86) PCT No.: PCT/EP2007/061890
§ 371 (c)(1),
(2), (4) Date: May 19, 2009

(87) PCT Pub. No.: WO2008/061869
PCT Pub. Date: May 29, 2008

(65) Prior Publication Data

US 2010/0051069 A1 Mar. 4, 2010

(30) Foreign Application Priority Data

Nov. 23, 2006 (DE) ..... 10 2006 055 350

(51) Int. Cl.
*A47L 15/14* (2006.01)
*A47L 15/50* (2006.01)

(52) U.S. Cl.
CPC ..... *A47L 15/502* (2013.01)

(58) Field of Classification Search
CPC ..... A47L 15/502
USPC ..... 134/25.2, 57 D, 56 D, 58 D, 135, 136, 134/137; 211/41.8
See application file for complete search history.

(56) References Cited

U.S. PATENT DOCUMENTS

| | | | | |
|---|---|---|---|---|
| 3,727,622 | A * | 4/1973 | Jacobs | 134/183 |
| 5,086,544 | A * | 2/1992 | Huttemann et al. | 211/41.8 |
| 8,196,593 | B2 * | 6/2012 | Schessl et al. | 134/135 |
| 2005/0028847 | A1 * | 2/2005 | Kaczmarek | 134/135 |
| 2006/0219271 | A1 * | 10/2006 | Feddema et al. | 134/56 D |
| 2006/0243681 | A1 * | 11/2006 | Bastuji et al. | 211/41.8 |
| 2007/0119801 | A1 * | 5/2007 | Miele et al. | 211/70.7 |
| 2008/0156362 | A1 * | 7/2008 | Shin et al. | 134/201 |
| 2008/0169009 | A1 | 7/2008 | Mailander | |

FOREIGN PATENT DOCUMENTS

| | | | |
|---|---|---|---|
| DE | 1910245 | | 11/1969 |
| DE | 3447302 | A * | 6/1986 |
| DE | 102004057018 | A1 * | 6/2006 |
| DE | 20023856 | U1 | 12/2006 |
| EP | 0186157 | B1 | 5/1989 |
| EP | 1275336 | A1 | 1/2003 |

OTHER PUBLICATIONS

Translation of DE 3447302.*

* cited by examiner

*Primary Examiner* — Alexander Markoff
(74) *Attorney, Agent, or Firm* — Michael E. Tschupp; Andre Pallapies; Brandon G. Braun

(57) ABSTRACT

A dishwasher including a washing compartment, and at least one cutlery basket arranged in the washing compartment, wherein the at least one cutlery basket holds items of cutlery horizontally, wherein at least some sections of the cutlery basket have different clearance heights.

18 Claims, 1 Drawing Sheet

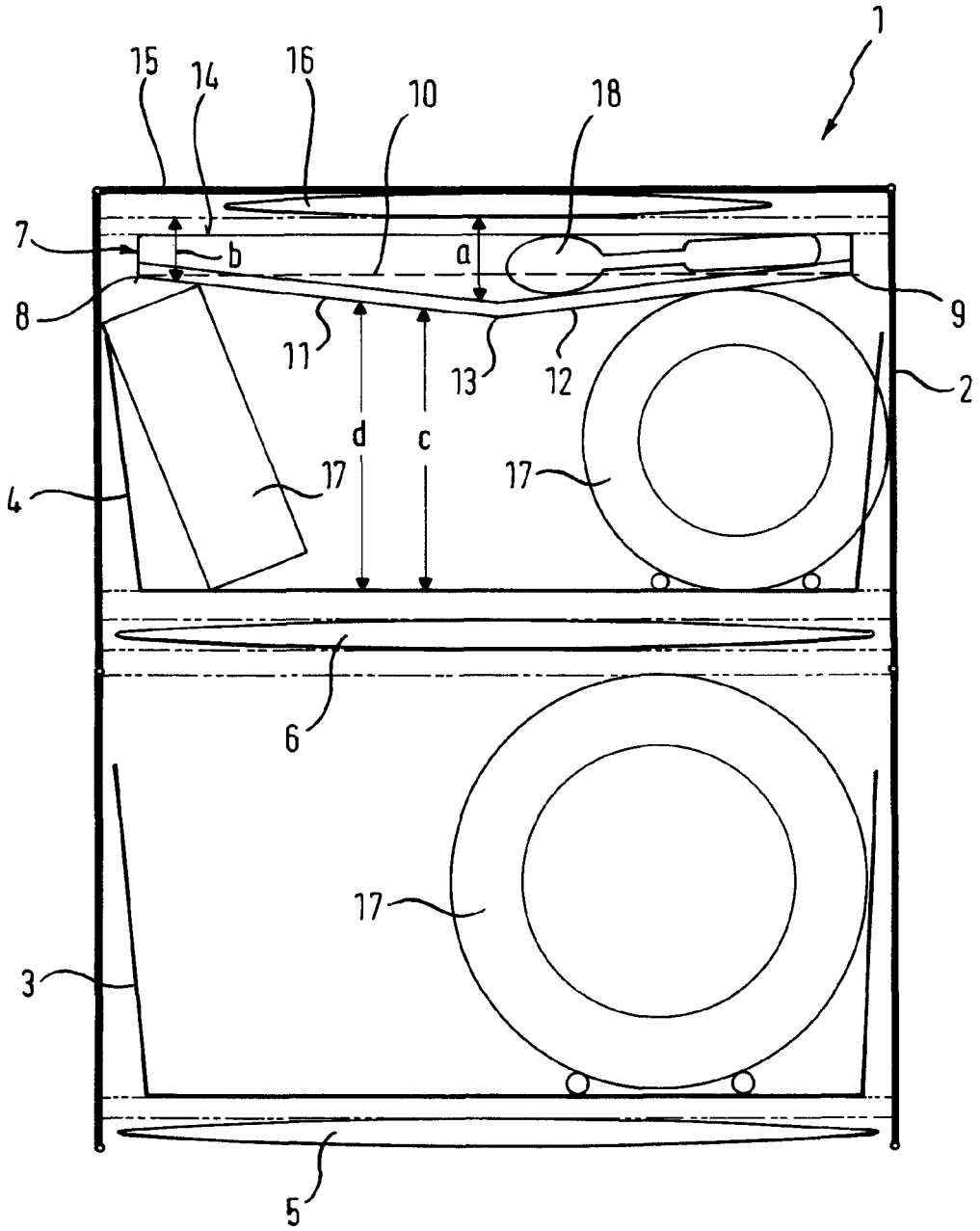
1
15
14
16
10
18
7
b
a
8
9
11
13
12
2
d
c
4
17
17
6
17
3
5

CUTLERY BASKET FOR A DISHWASHER AND DISHWASHER

BACKGROUND OF THE INVENTION

The invention relates to a dishwasher in accordance with the exemplary embodiments described herein.

A dishwasher with a generic cutlery basket is known from EP 0 186 157 B1. The cutlery basket described therein is embodied as a drawer and provides the option of accommodating conventional cutlery such as knives, forks, spoons etc., and holding them in a position favorable for the effectiveness of the dishwashing program. To make optimum use of the restricted space available in the washing compartment, the height of the cutlery drawer is chosen so that spoons with a large lip of standard cutlery can be held there without any problem. Cutlery items which have greater dimensions, such as for example serving utensils, ladles etc. cannot be put in the cutlery drawer, since the dimensions of the items of cutlery do not allow the cutlery drawer to be slid into the dishwasher. These cutlery items must either be washed manually or must be placed in the crockery basket so that a reliable draining-off of the washing liquor can be guaranteed.

SUMMARY OF THE INVENTION

The object of the present invention is thus to specify a cutlery basket for holding items of cutlery in a horizontal position for use in a dishwasher which, for optimum utilization of space in the washing compartment, can accept items of cutlery with larger dimensions for washing and simultaneously produces a good cleaning and drying result for said items.

This problem is solved by the objects with the features of the independent claims. Advantageous embodiments of the invention are reflected in the dependent claims.

The cutlery basket of an inventive dishwasher is characterized by at least sections of the cutlery basket having different clearance heights, which guarantee an optimized utilization of space. I.e. that the floor area is embodied differently from a horizontal plane (in the installed position) extending between a first and a second side edge of the floor area. There is provision for sections of the floor area or the entire floor area to slope or be curved over their entire length. This guarantees that larger items of cutlery can be accommodated while simultaneously providing maximum space utilization. Because of the "angled" storage of the cutlery items the draining-off of water during the drying process of the cutlery items is improved, meaning that less energy is required for drying by comparison with cutlery baskets in which the cutlery items are essentially held horizontally. A subsidiary effect produced is an increased stability in the shape of the cutlery basket.

The cutlery basket can be embodied in a stepped form for this purpose. However there is preferably provision for at least sections of the cutlery basket to have continuously variable clearance heights, so that sloping levels are formed.

There is preferably provision for the cutlery basket to be arranged above an upper crockery basket in the washing compartment of the dishwasher. In this case there is also provision for at least sections of the crockery basket to have different clearance heights in relation to the cutlery basket, so that the utilization of space in relation to the crockery basket is optimized at the same time.

For an optimized utilization of space of the washing area provided by the dishwasher it is useful for the cutlery basket to directly adjoin a compartment roof of a washing compartment of the dishwasher with its upper edge.

In a further preferred embodiment a separate spray device for applying washing liquor to the cutlery is arranged in the cutlery basket. This is expediently arranged above the cutlery basket so as to achieve an efficient application of washing liquor to the items of cutlery.

The floor area can have at least one section in the shape of a circle segment which is designed in each case for accommodating cutlery. The floor area can also comprise a first part area and a second part area which are embodied in each case for accommodating cutlery items, with the first and the second part area being arranged at an oblique angle to each other. This produces an especially advantageous arrow-shaped design of the cutlery basket. The result of this is a high flexibility in the loading of the cutlery basket as well as of the crockery basket of the dishwasher arranged below it. Thus in an arrow-shaped cutlery basket large items of cutlery, or even smaller items of crockery, such as cups, can be accommodated in the area of the adjoining first part area and second part area. The items of cutlery, such as spoons, ladles or serving utensils are preferably sorted into the basket such that they are oriented with their handles from the narrowed area towards the widened area. In such cases the lips, prongs etc. end up being located in the widened areas. The space gained below the narrowed areas is to the benefit of the crockery basket arranged below them.

In a further embodiment the floor area is embodied as wide-mesh grid with grid bars, with at least some of the grid bars being arranged at an angle, especially an acute angle to the horizontal. The angled position of at least some of the grid bars allows easier passage of the water of a spray arm arranged below the cutlery basket. The stability of the cutlery basket is also increased.

The cutlery basket can be embodied as a flat slide-in unit with or without wheels and can consist of a frame as well as one or more basket inserts able to be removed from the frame, preferably in the form of wide-mesh filter inserts. In other words the cutlery basket is preferably embodied as a cutlery drawer.

An inventive dishwasher comprises a cutlery basket as described above. The cutlery basket is preferably supported and guided above a, preferably upper, crockery basket in a washing area of the dishwasher like a removable drawer.

The present invention has succeeded in providing a cutlery basket for accommodating cutlery in a horizontal position, which, if the need arises, can accept cutlery with larger dimensions of even smaller crockery for washing, with the washing compartment simultaneously being used in the optimum way and the drying of the items held in the cutlery basket having been improved.

BRIEF DESCRIPTION OF THE DRAWINGS

A preferred embodiment of the present invention is shown below with reference to drawings. The single FIGURE shows a front view in a dishwasher with an inventive cutlery basket.

DETAILED DESCRIPTION OF THE EXEMPLARY EMBODIMENTS OF THE PRESENT INVENTION

The arrangement shows a front-loading dishwasher 1 which, in a washing compartment 2 in a known manner, has a lower crockery basket 3, an upper crockery basket 4 and also spray arms 5 and 6 assigned to these crockery baskets.

Above the upper crockery basket 4 is arranged an inventive cutlery basket 7, which in the exemplary embodiment has a floor area consisting of a first part area 11 and a second part area 12. The first and the second part area 11, 12 adjoin each other at an oblique angle. This forms a connecting edge 13 approximately in the center between a first and a second side edge 8, 9 which is located below a horizontal level 10, in which the first and the second side edge 8, 9 of the floor area running in parallel thereto are arranged. This produces an arrow-shaped design of the cutlery basket 7 with sections with continuously varying clearance heights. The narrowing of the cutlery basket can be both from the center outwards towards the first and second side edge (see exemplary embodiment) and also in the reverse direction in towards the center.

The cutlery basket is embodied to hold items of cutlery in a horizontal position, with for example an item of cutlery 18 in the form of a spoon or a ladle being shown in a preferred arrangement. The arrow-shaped design of the cutlery basket 7 and placing the bowl of the spoon in the direction of the lowered center means that the spoon does not extend over the upper edge of the cutlery basket 14. Because of the shape narrowing from the connecting edge 13 outwards (in the direction of the side edges 8, 9), an increased amount of space is available for the crockery basket 4 arranged below the cutlery basket 7 as a result of the increased clearance height. Items of crockery 17 in the form of a plate and a tall glass are depicted as examples in the crockery basket 4, which exploit the additional space. Furthermore the cutlery basket 7, since no items of cutlery extend beyond the upper edge of the cutlery basket 14, can be placed immediately adjacent to a compartment roof 15 of the dishwasher 1 unless there is provision for a spray arm 16.

In the exemplary embodiment an optional spray arm 16 is assigned to the cutlery basket 7 above an upper edge of the cutlery basket 14 of the inventive cutlery basket 7, which applies washing liquor from above to the items of cutlery lying in a horizontal position in the cutlery basket 7. Since projection of the items of cutlery above the upper edge of the cutlery basket 14 is avoided, this arm can rotate unhindered to apply washing liquor to the items of cutlery/crockery in the cutlery basket 7.

As well as the gain in space obtained by the upper crockery basket 4 the floor area running essentially fully sloping or curved by comparison with a horizontal plane has the advantage that washing liquor can better drain off the items of cutlery held at an angle. This gives an improved drying result or a lower energy requirement for drying the items of cutlery. The arrow-shape or also a possible circle segment shape of the cutlery basket 7 further increases the form stability of the cutlery basket. Because of the lack of reinforcement which might otherwise be necessary the costs of production are reduced.

The cutlery basket 7 can be embodied in the floor area as a wide-mesh grid with grid bars, with plastic preferably being used as the material the cutlery basket 7. It is also conceivable for the cutlery basket to be made of metal. At least some of the grid bars can be arranged at an angle, especially an acute angle, to the horizontal, facilitating the passage of water where a separate spray arm is assigned to the cutlery basket 7.

The cutlery basket 7 can be embodied as a flat slide-in unit which is supported to allow its removal from the washing compartment of the dishwasher 1 in the manner of a drawer. For this reason the cutlery basket can consist of a frame (not shown) as well as one or more frame inserts which can be taken out of the frame.

With the present invention a cutlery basket as well as a dishwasher are provided which allow a maximum utilization of space for the cutlery basket and for a crockery basket arranged below it. The cutlery basket can also accept items of crockery with larger dimensions, with the angled storage of the crockery items improving the draining of the washing liquor thus providing an improved drying result.

LIST OF REFERENCE SYMBOLS

1 Dishwasher
2 Dishwasher compartment
3 Crockery basket
4 Crockery basket
5 Spray arm
6 Spray arm
7 Cutlery basket
8 Side edge
9 Side edge
10 Horizontal plane
11 Part area
12 Part area
13 Connecting edge
14 Upper edge of cutlery basket
15 Compartment roof
16 Spray arm
17 Dishes
18 Cutlery item (spoon)
a Cutlery basket clearance height
b Cutlery basket clearance height
c Crockery basket clearance height
d Crockery basket clearance height

The invention claimed is:

1. A dishwasher comprising:

a washing compartment including side walls; and at least one cutlery basket arranged in the washing compartment, the cutlery basket including a floor area to support cutlery items thereon, the floor area having a first part area and a second part area wherein a surface of an underside of the first part area and a surface of an underside of the second part area converge from a first side edge and a second side edge, respectively, to a straight linearly extending first connecting edge at about the centerline of the cutlery basket, wherein the first connecting edge is spaced a first predetermined descending distance from a horizontal plane extending from the first side edge to the second side edge, and wherein a surface of a topside of the first part area and a surface of a topside of the second part area converge at a straight linearly extending second connecting edge which is spaced a second predetermined descending distance from the horizontal plane, thereby defining a floor area having a continuously variable depth forming a downwardly directed arrow-shaped portion wherein the centerline is at a greater distance from the horizontal plane than the side edges, thus forming a storage area having a clearance height with respect to an upper edge of the cutlery basket that gradually increases continuously from the first and second side edges, respectively, to about the centerline of the cutlery basket, wherein the cutlery basket is configured as a slide-in unit to slide into the washing compartment such that when the cutlery basket is inserted into the washing compartment the first side edge and the second side edge of the cutlery basket are opposed to respective side walls of the washing compartment.

2. The dishwasher as claimed in claim 1, further comprising:

an upper crockery basket in the washing compartment, wherein the cutlery basket is arranged above the upper crockery basket in the washing compartment of the dishwasher.

3. The dishwasher as claimed in claim 2, wherein at least some sections of the upper crockery basket have different clearance heights in relation to the cutlery basket.

4. The dishwasher as claimed in claim 1, wherein the upper edge of the cutlery basket directly adjoins a compartment roof of the washing compartment of the dishwasher.

5. The dishwasher as claimed in claim 1, further comprising:

a spray device that applies washing liquor to the items of cutlery in the cutlery basket.

6. The dishwasher as claimed in claim 5, wherein the spray device is arranged above of the cutlery basket.

7. The dishwasher as claimed in claim 1, wherein the cutlery basket includes at least one circle segment-shaped section that accommodates items of cutlery.

8. The dishwasher as claimed in claim 1, wherein a plane of each of the first part area and the second part area is arranged at an oblique angle to the other plane.

9. The dishwasher as claimed in claim 1, wherein the floor area includes a wide-mesh grid having grid bars.

10. The dishwasher as claimed in claim 1, wherein the dishwasher is a domestic dishwasher.

11. The dishwasher as claimed in claim 8, wherein a first upper clearance height between a side edge of the first part area of the cutlery basket and the roof of the washing compartment is different than a center upper clearance height between the connecting edge of the cutlery basket and the roof of the washing compartment.

12. The dishwasher as claimed in claim 11, wherein the first upper clearance height is less than the center upper clearance height.

13. The dishwasher as claimed in claim 11, comprising:

an upper crockery basket in the washing compartment, wherein the cutlery basket is arranged above the upper crockery basket in the washing compartment of the dishwasher, and wherein a first lower clearance height between the side edge of the first part area of the cutlery basket and the upper crockery basket of the washing compartment is different than a center lower clearance height between the connecting edge of the cutlery basket and the upper crockery basket of the washing compartment.

14. The dishwasher as claimed in claim 13, wherein the first lower clearance height is greater than the center lower clearance height.

15. A dishwasher comprising:

a washing compartment having a roof, a floor, and a plurality of sides; and at least one cutlery basket arranged in the washing compartment, the cutlery basket including a floor area to support cutlery items thereon, the floor area comprising a first part area and a second part area with a surface of an underside of the first part area and a surface of an underside of the second part area converging from a first side edge and a second side edge, respectively, to a straight linearly extending first connecting edge at about the centerline of the cutlery basket, wherein the first connecting edge is spaced a first predetermined descending distance from a horizontal plane extending from the first side edge to the second side edge, and wherein a surface of a topside of the first part area and a surface of a topside of the second part area converge at a straight linearly extending second connecting edge which is spaced a second predetermined descending distance from the horizontal plane, thereby defining a floor area having a continuously variable depth forming a downwardly directed arrow-shaped portion wherein the centerline is at a greater distance from the horizontal plane than the side edges, thus forming a storage area of the cutlery basket having a clearance height with respect to an upper edge of the cutlery basket that gradually increases continuously from the first and second side edges, respectively, to about the centerline of the cutlery basket, an upper crockery basket in the washing compartment, wherein the cutlery basket is arranged above the upper crockery basket in the washing compartment of the dishwasher, and wherein a storage area of the upper crockery basket has a clearance height with respect to the underside of the first part area and the underside of the second part area that gradually increases continuously from about the centerline of the cutlery basket to, respectively, the first and second side edges.

16. A cutlery basket for a dishwasher for disposition in a washing compartment thereof, the cutlery basket comprising a floor area to support cutlery items thereon, the floor area including a first part area and a second part area with the first part area and the second part area being arranged at an oblique angle to each other, wherein a surface of an underside of the first part area and a surface of an underside of the second part area converge from a first side edge and a second side edge, respectively, to a straight linearly extending first connecting edge at about the centerline of the cutlery basket, wherein the first connecting edge is spaced a first predetermined descending distance from a horizontal plane extending from the first side edge to the second side edge, and wherein a surface of a topside of the first part area and a surface of a topside of the second part area converge at a straight linearly extending second connecting edge which is spaced a second predetermined descending distance from the horizontal plane, thereby defining a floor area having a continuously variable depth forming a downwardly directed arrow-shaped portion wherein the centerline is at a greater distance from the horizontal plane than the side edges, thus forming a storage area having a clearance height with respect to a roof of the washing compartment that gradually increases continuously from the first and second side edges, respectively, to about the centerline of the cutlery basket.

17. The cutlery basket of claim 16, wherein a plane of each of the first part area and the second part area is arranged at an oblique angle to the other plane.

18. The cutlery basket of claim 16, wherein the floor area includes a wide-mesh grid having grid bars.

* * * * *